US007243589B2

(12) United States Patent
Ireland et al.

(10) Patent No.: US 7,243,589 B2
(45) Date of Patent: Jul. 17, 2007

(54) VARIABLE VOLUME CHAMBER CANNON

(75) Inventors: Jeff Ireland, Rosemount, MN (US); Dave Burger, Minneapolis, MN (US); Lonnie Hannah, Monticello, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 90 days.

(21) Appl. No.: 11/060,233

(22) Filed: Feb. 17, 2005

(65) Prior Publication Data

US 2006/0065110 A1 Mar. 30, 2006

Related U.S. Application Data

(60) Provisional application No. 60/545,641, filed on Feb. 18, 2004.

(51) Int. Cl.
*F41A 3/00* (2006.01)

(52) U.S. Cl. ..... 89/17

(58) Field of Classification Search ..... 89/1.1, 89/17, 19, 20.2, 20.4
See application file for complete search history.

(56) References Cited

U.S. PATENT DOCUMENTS

| | | | | |
|---|---|---|---|---|
| 43,412 | A * | 7/1864 | Hubbell | 89/17 |
| 474,289 | A * | 5/1892 | Canet | 89/20.2 |
| 565,163 | A * | 8/1896 | Gledhill | 89/20.2 |
| 693,900 | A * | 2/1902 | Perry | 89/19 |
| 1,326,580 | A * | 12/1919 | Dawson et al. | 89/20.2 |
| 1,477,078 | A * | 12/1923 | Rimailho | 89/1.1 |
| 1,488,439 | A * | 3/1924 | Rimailho | 89/17 |
| 5,341,720 | A * | 8/1994 | Franzen et al. | 89/45 |
| 5,663,519 | A | 9/1997 | Müller | |
| 6,186,041 | B1 | 2/2001 | Menges | |
| 6,571,676 | B1 | 6/2003 | Folsom et al. | |
| 6,810,615 | B2 | 11/2004 | Hermanson et al. | |

* cited by examiner

*Primary Examiner*—Michael J. Carone
*Assistant Examiner*—Bret Hayes
(74) *Attorney, Agent, or Firm*—Patterson, Thuente, Skaar & Christensen, P.A.

(57) ABSTRACT

An assembly for effecting a variable volume chamber for use in a cannon having a breech assembly operably coupled to a chamber, and includes the chamber having a certain size being partially defined by a constant diameter for a known depth dimension and having a known volume and a breech plug assembly disposable in the chamber to a selectively variable depth, the depth being less than the known depth of the chamber such that the plug fills a first selectively variable portion of the known volume of the chamber, thereby leaving a second variable portion of the known volume of the chamber free and defining a chamber variable volume. A Cannon including the variable volume chamber and a method of effecting a variable volume chamber are further included.

43 Claims, 15 Drawing Sheets

VARIABLE VOLUME CHAMBER CANNON

RELATED APPLICATION

This application claims priority to U.S. Provisional Application Ser. No. 60/545,641, filed Feb. 18, 2004, titled VARIABLE VOLUME CHAMBER CANNON, which is incorporated herein in its entirety by reference.

FIELD OF THE INVENTION

This invention pertains to long-range artillery, and more particularly, to artillery having the ability to readily shift fire over a number of different zones.

BACKGROUND OF THE INVENTION

There is an intimate relationship between cannon chamber volume and propellant performance. In an artillery cannon that fires multiple zones, it is important that complete burning occur and pressures remain manageable at all firing zones. In a fixed volume chamber cannon, complete burning and manageable pressure usually cannot be achieved over the desired range of operation simply by varying the amount of the same type of propellant. In the past, cannon developers addressed this problem by using different types and/or configurations of propellant for shots at different zones. Theoretically, a cannon with a variable volume chamber offers increased flexibility to the cannon and propellant developer by removing the constraint associated with fixed volume. Further, a variable volume chamber theoretically provides an opportunity to more easily adapt propellant from one cannon to another.

A well designed variable volume chamber cannon can deliver different muzzle exit velocities to the projectile either by changing the chamber volume or by changing the amount of propellant in the chamber. The ability to vary muzzle velocity allows for improved zoning characteristics and greater Multiple Round Simultaneous Impact (MRSI) capability.

A design for a variable volume chamber cannon is documented in U.S. Pat. No. 6,571,676 to Folsom et al., and describes chambers of volumes situated on a turntable. The operator selects the appropriate chamber for firing. Alternatively there have been discussions regarding cannons with peripheral chambers adjacent to the primary chamber with valves in between. Under this concept it may be possible to increase the effective chamber volume by opening valves between the primary chamber and the peripheral chamber to accommodate the maximum amount of propellant, but this method does not allow for the reduction of the primary chamber volume for smaller amounts of propellant. The Folsom device has not proved to be practical in the field. Thus there remains a need for a cannon with an adjustable chamber volume so as to provide the developer and user with greater flexibility.

SUMMARY OF THE INVENTION

This invention for a Variable Volume Chamber Cannon permits multiple chamber volumes to be selected for a variety of desired propellant quantities and formulations. This invention also provides for a more capable and optimized uni-charge propellant system, where different muzzle exit velocities can be achieved by varying the number of uni-charge modules and/or the chamber volume without the disadvantages associated with the present uni-charge system in a fixed chamber volume cannon. This invention further provides that the variable volume chamber cannon can deliver a greater number of projectile muzzle exit velocities than a fixed chamber volume cannon using the same propelling charge system. Additionally, this invention provides the capability for a cannon system to use a propellant charge that was developed for a cannon system having a different bore diameter, thereby minimizing the number of propellant charge systems that must be supplied to the field.

Specifically, the present invention may use existing modular artillery charge system (MACS) developed for 155 millimeter cannon in a cannon of 105 millimeter bore diameter, thus allowing charges not specifically designed for this new cannon to be adapted to this application. This present invention also allows for varying the projectile muzzle exit velocity, for a given amount of propellant, as a function of the chamber volume size.

The present invention is an assembly for effecting a variable volume chamber cannon having a barrel and breech assembly. In an embodiment, the barrel consists of a rifled gun tube, having a certain bore diameter at the muzzle end and a combustion chamber of known, fixed volume at the opposed breech end. The variable portion of the combustion chamber geometry is of fixed diameter for a given depth from the rear face of the gun barrel and is varied by insertion of a breech plug assembly into the known volume, thereby reducing the effective volume of the chamber to a desired and variable volume.

The exemplary breech assembly coupled to the breech end of the gun tube (barrel) comprises of the breech ring, breech carrier, breech plug assembly and their associated operating mechanisms (i.e. gears, drives, motors, etc.). The breech ring is coupled to the breech end of the gun barrel and has lug features that engage corresponding features of the breech carrier that allow for both the transfer of firing loads and the ability to translate radially from the barrel centerline to permit the loading of ammunition.

An exemplary breech carrier incorporates an interrupted thread feature that aligns with the gun barrel bore centerline when the breech carrier is in the firing position. The breech carrier interrupted thread features engage corresponding features of the breech plug assembly that allow for the transfer of firing loads. The breech plug interrupted thread feature can be disengaged from those of the breech carrier by rotating the breech plug assembly and thus allowing the breech plug assembly to translate axially into the fixed diameter chamber to adjust the chamber volume or axially retract completely clear of the rear face of the gun barrel allowing the breech carrier with the breech plug assembly to be radially translated off-bore axis for ammunition loading.

The interrupted thread feature allows the breech plug assembly to be locked to the breech carrier at various breech plug depths providing multiple chamber volumes. The breech plug assembly seals combustion gases when positioned at any location along the fixed diameter portion of the chamber wall. The breech plug assembly is designed to accommodate the ignition source for the propelling charges at all chamber volume positions.

The exemplary breech plug assembly includes the breech plug, spindle assembly, breech seal assembly, backing ring, belleville springs, spacer, preload nut, and preload nut keys. The spindle assembly includes the spindle, laser window, laser window seal washer, spindle shim, spindle extension, spindle lock, and spindle lock retaining pins. The breech seal assembly includes the breech seal, and three seal rings. The seal rings act as both anti-extrusion rings and as heat shields protecting the elastomer breech seal from hot combustion gases.

Features of this barrel that differentiate it from a typical prior art barrel are the chamber with a fixed diameter region, the breech seal that sealingly operates between the spindle and the chamber wall in the fixed diameter region of that chamber at any disposition within the fixed diameter region, and the interrupted threads between the plug and the carrier that locks at essentially any desired depth in the chamber, thereby effecting a variable volume of the chamber.

The present invention for varying the volume of the cannon chamber generally requires that the spindle be capable of sealing in more than one position in the chamber, which precludes the use of a prior art sealing chamfer on the gun tube. Many modern artillery cannon use modular (uncased) propellant that is separated from the projectile. Without a case for the propellant, it is necessary for the cannon to ensure that exhaust gases do not escape from the breech during firing, task otherwise assumed by the case. This is typically presently accomplished by a seal that is forced against a chamfered surface machined in the chamber in a prior art device. Such sealing results in the same volume of the chamber for each shot. In distinction, the present invention includes the spindle that is configured to seal against the constant diameter chamber wall at various depths rather than against a prior art chamfer, thereby resulting in variable chamber volumes.

In typical prior art cannon, the chamfered seal is supported during firing by a block that locks the breech of the chamber. This block typically swings (hinged) or slides (breech block) out of the way for loading of the cannon and is held in its locked position by either lugs or threads during firing.

In distinction to the means of opening noted immediately above, the breech of the present invention is opened by rotating the breech plug assembly within the breech carrier to unlock the interrupted threads. The breech plug assembly is then translated aft until the spindle and breech plug are removed from the chamber. Next, the breech carrier and breech plug assembly are translated radially with respect to the barrel longitudinal axis to clear the path to the chamber for ammunition loading.

To close the breech, the sequence is reversed. The breech carrier and breech plug assembly are translated radially to align the breech plug assembly with the chamber bore axis. The breech plug assembly is translated forward a selected depth into the position that provides the desired chamber volume. The breech plug assembly is then rotated to interlock the interrupted threads between the breech plug assembly and the breech carrier.

The present invention is an assembly for effecting a variable volume chamber for use in a cannon having a barrel, the barrel having at least one certain bore diameter and having a muzzle end and an opposed breech end, the chamber disposed at the breech end, and a breech assembly operably coupled to the chamber, and includes the chamber having a certain size being partially defined by a constant diameter for a known depth dimension and having a known volume and a breech plug assembly disposable in the chamber to a selectively variable depth, the depth being less than the known depth of the chamber such that the plug fills a first selectively variable portion of the known volume of the chamber, thereby leaving a second variable portion of the known volume of the chamber free and defining a chamber variable volume. Cannon including the variable volume chamber and a method of effecting a variable volume chamber are further included in the present invention.

DETAILED DESCRIPTION OF THE DRAWINGS

Figure 1:
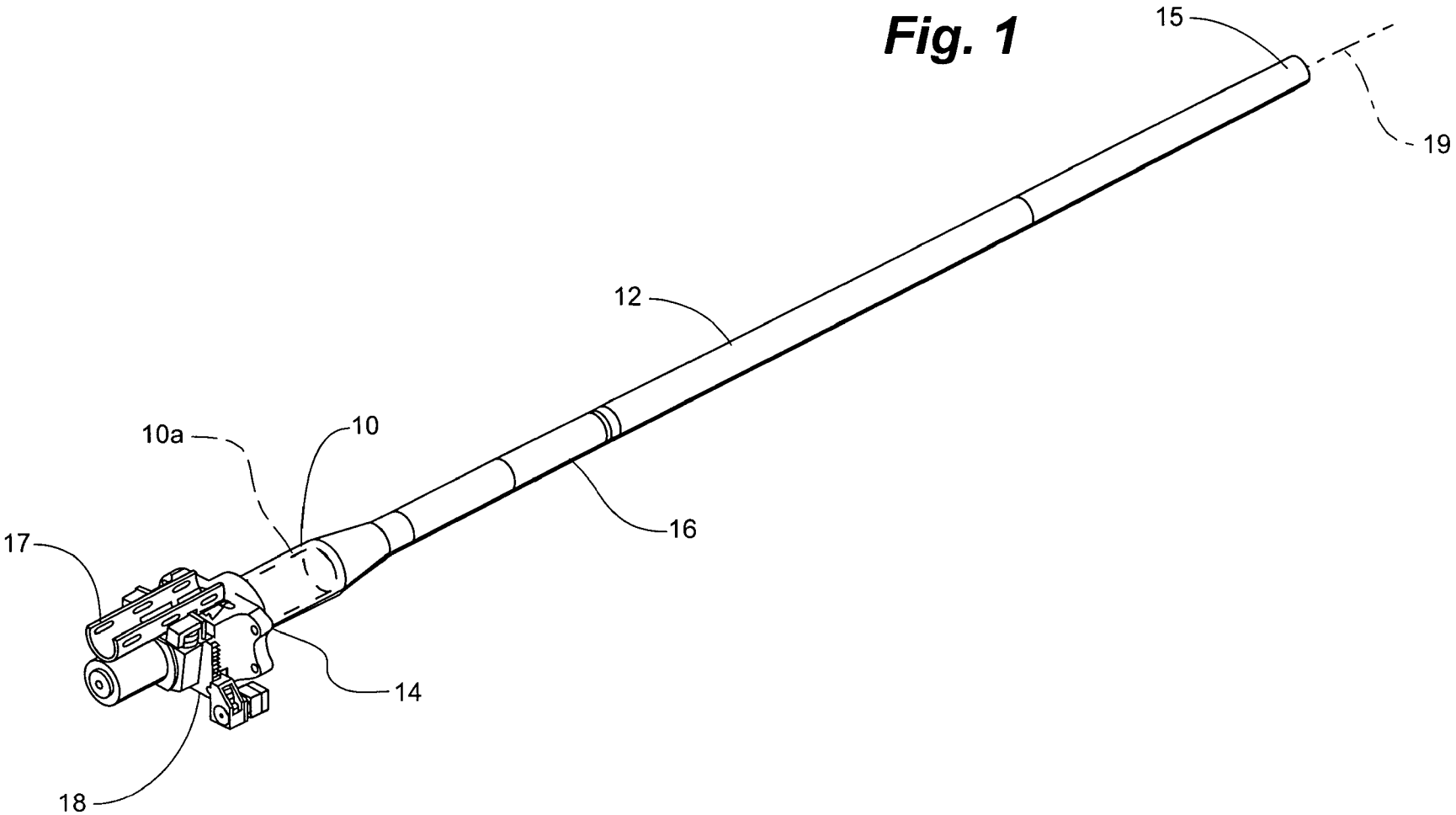
FIG. 1 is a perspective view of the variable volume chamber cannon of the present invention.

The variable volume chamber of a first embodiment of the present invention is depicted generally at 10 in the FIGS. 1–10*b* and is intended for use on an indirect fire or multi-role armament for military ground forces such as a self-propelled howitzer, but it is applicable to other armament uses as well. FIG. 1 provides an illustration of the present invention incorporated with an exemplary 105 mm 62 caliber barrel 16. The variable volume chamber assembly 10 is disposed at a first (breech) end 14 of the cannon barrel 16 opposed to the second (muzzle) end 15. A breech assembly 18 contains the means for adjusting the volume of the variable volume chamber 10*a* as well as providing access to the barrel 16 for loading propellants and munitions via the loading tray 17. The exemplary variable volume chamber assembly 10 depicted is specifically designed in this embodiment to use a propellant that is designed for use in a 155 mm cannon, but other propellants are useable and other bore sizes are also applicable.

The volume of the chamber 10*a* is known and fixed. The means for adjusting the effective volume of the variable volume chamber 10*a* is primarily the function of the breech plug assembly 20, as depicted in FIGS. 2–5. Generally, the breech plug assembly 20 is insertable to a selected depth into the variable volume chamber 10*a*. The breech plug assembly 20 is extended through the breech assembly 18 into the variable volume chamber 10*a* to control the chamber volume of chamber 10*a*. The further into the variable volume chamber 10*a* that the breech plug assembly 20 is inserted, the greater the volume displaced by the breech plug assembly 20 resulting in a smaller chamber volume for the propellant.

Figure 2:
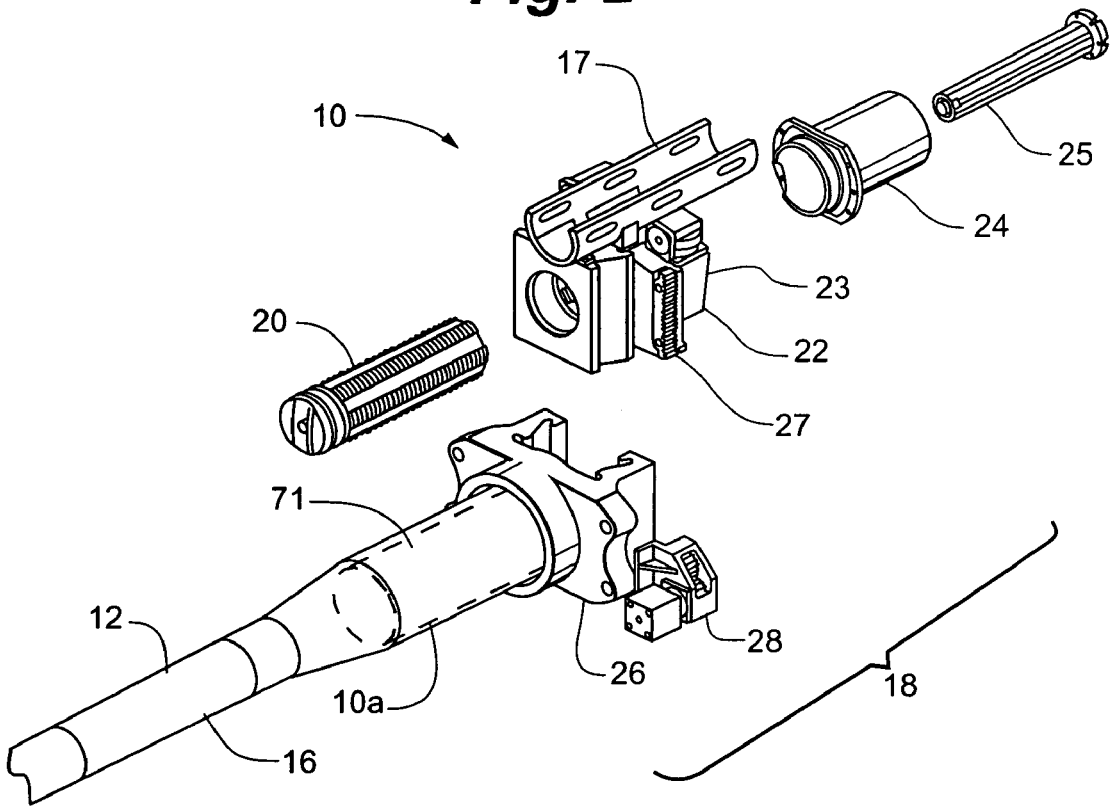
FIG. 2 is a exploded view of the variable volume chamber cannon of the present invention.

FIG. 2 illustrates some of the components included within the breech assembly 18. The components of the breech assembly 18 include generally the load tube 17 fixedly mounted on a shiftable breech carrier 23 of a breech carrier assembly 22. The breech carrier assembly 22 is radially translatably mounted within a fixed (nontranslatable) breech ring 26. The breech plug assembly 20 is axially translatably disposed in the breech carrier assembly 22.

A pair of opposed, outwardly directed breech carrier racks 27 (the left rack 27 of the two racks 27 being depicted) are disposed on opposing faces of the breech carrier 23. The breech carrier racks 27 are operably connected to a breech carrier drive mechanism 28. The breech carrier drive mechanism 28 is mounted to the breech ring 26. The breech carrier drive mechanism 28 provides means to raise and lower the breech carrier assembly 22 relative to the breech ring 26 for loading of the cannon 12 when the breech carrier drive mechanism 28 is actuated by an electric motor 103, the electric motor 103 being depicted in FIGS. 10*a, b*.

Figure 3:
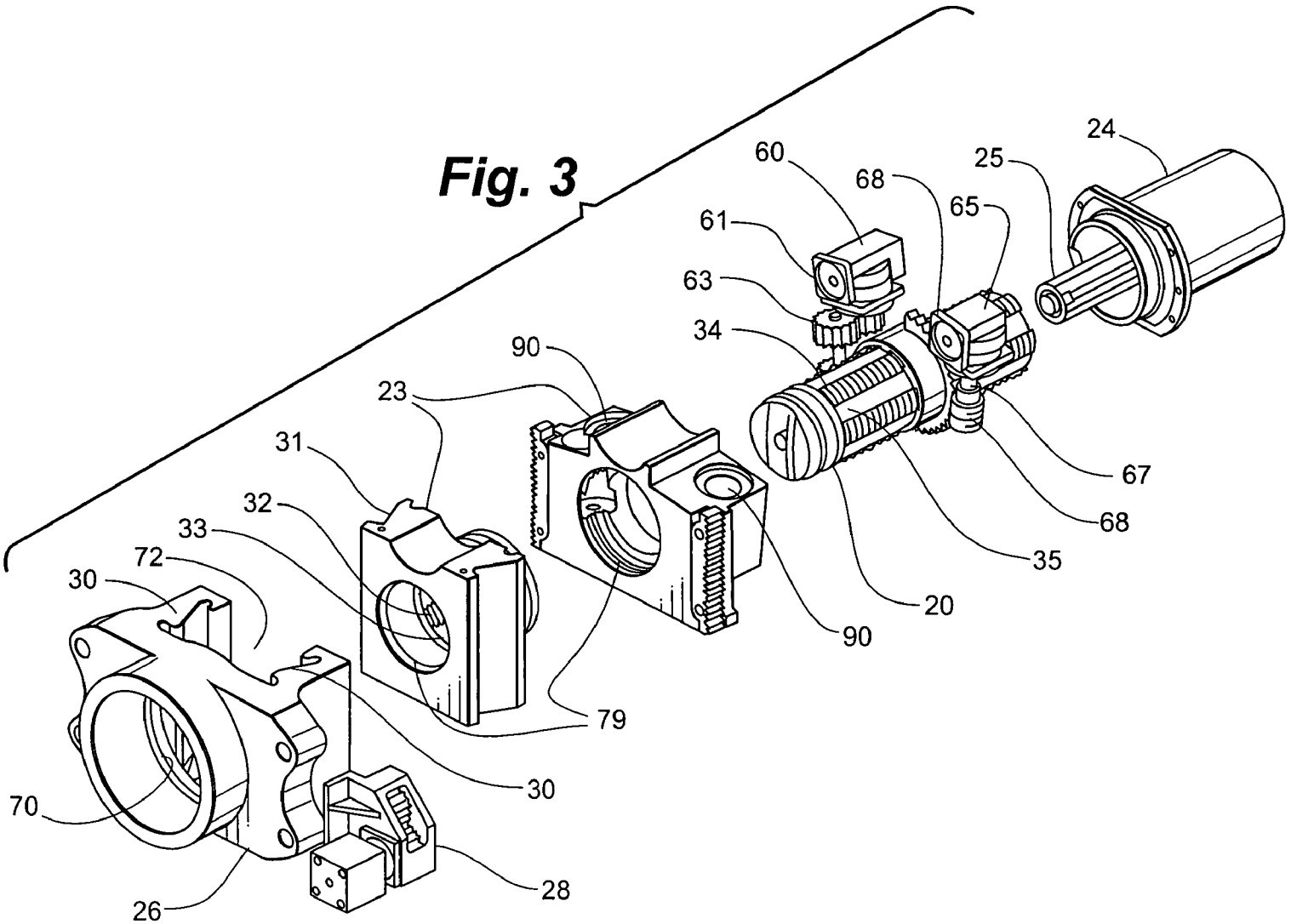
FIG. 3 is a exploded view of the breech carrier assembly.

As depicted in FIG. 3, the breech ring 26 is generally formed in a "U" shape, open to the rear as viewed from above and having opposed breech ring lugs 30 to embrace the breech carrier lugs 31 of the breech carrier 23. The aft facing open end of the "U" shape is designed for axial translation of the breech plug assembly 20 therethrough and for passage of ammunition components therethrough to the variable volume chamber 10*a*. The breech ring 26 has a circular opening 70 in registry with the open end of the "U" shape and disposed coaxially with the bore axis 19 for access to cannon chamber 10*a*. The circular opening 70 opens at a forward end into a central chamber bore 71 (see FIG. 2) having bore axis 19 and defining the chamber 10*a* and opens at a rearward end into the space 72 defined between the lugs 30.

Figure 8:
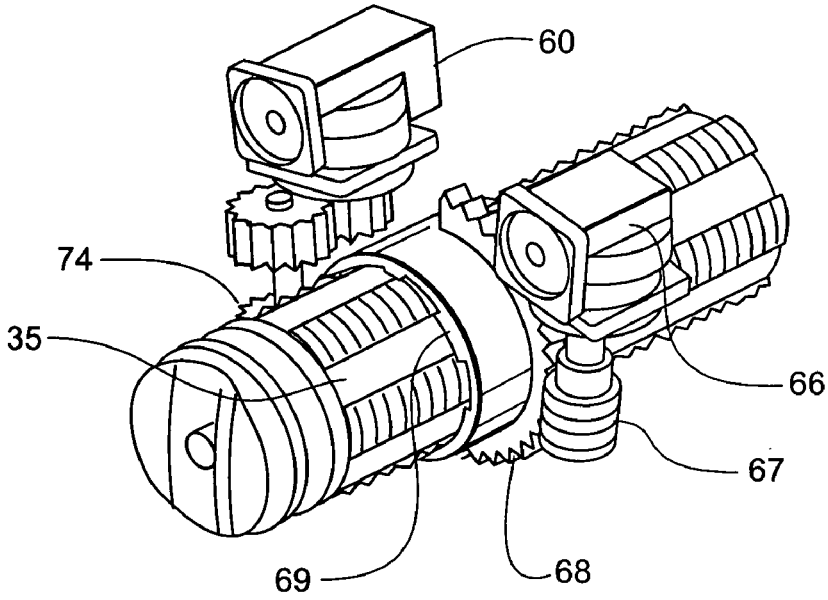
FIG. 8 is a perspective view depicting the breech plug assembly lock/unlock mechanism and translate mechanism components.
Figure 9:
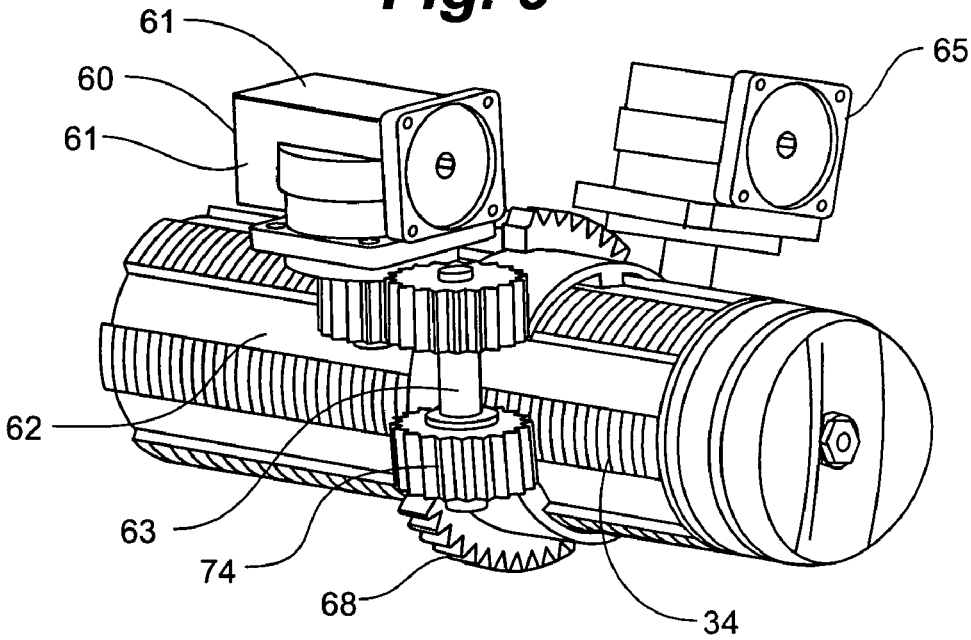
FIG. 9 is view depicting breech plug assembly lock/unlock mechanism and translate mechanism components.

The lock/unlock mechanism 65 is mounted to the breech carrier 23 for effecting locking/unlocking of the breech plug assembly 20 and the breech plug translate mechanism 60 65 is mounted to the breech carrier 23 for effecting translation of the breech plug assembly 20. As illustrated in FIGS. 3, 8 and 9, the breech carrier 23 includes a pair of angled bores 90 (see specifically FIG. 3) that respectfully mount the breech plug translate mechanism 60 lock/unlock drive 66 and a worm drive 67 and lock/unlock mechanism 65 worm drive 67 and worm sector gear 68 on opposing sides of the breech carrier 26. Breech carrier lugs 31 form a portion of the breech carrier 23 for lowering/raising the breech plug assembly 20 in cooperation with the lugs 30, noted above.

The breech carrier 23 further contains internal interrupted threads 32 and interruptions 33 between the interrupted threads 32 for locking/unlocking the breech plug 20 and for translating the breech plug 20. Accordingly the internal interrupted threads 32 interact (selectively engage) the external interrupted threads 34 of the breech plug assembly 20. Engaging the threads 32 and 34 is effected by actuation of the lock/unlock mechanism 65 acting through worm gear 67. Such actuation acts to rotate the breech plug assembly 20 by means of sector gear internal splines 69 (disposed in the breech plug interruptions 33 and engaging the side margins of the breech plug interrupted threads) to selectively rotationally lock/unlock the breech plug assembly 20 in the variable volume chamber 10*a*. See arrow 100 of FIG. 10*a*. The worm gear 67 on the locking transmission shaft engages the locking gear 68 and, when activated, rotates the breech plug assembly 20 to engage/disengage the interrupted threads 34 of the breech plug assembly 20 with the interrupted threads 32 of the breech carrier 23 when the breech plug assembly 20 is disposed at the desired depth position in the variable volume chamber 10*a* to yield the desired chamber volume.

To effect locking/unlocking of the breech plug 20, the worm drive 67 of the translate mechanism 65 engages sector gear 68. Actuation of the worm drive 67 in the appropriate rotational direction acts to rotate the breech plug assembly 20 about the bore axis 19 such that the breech carrier interrupted threads 32 lockingly engage the breech plug interrupted threads 34 (the breech plug interruptions 35 being aligned with the breech carrier interruptions 33) to lock the breech plug assembly 20 or in the opposite direction such that the breech carrier interrupted threads 32 disengage the breech plug interrupted threads 34 (the breech plug interruptions 35 and the breech carrier interruptions 33 being respectively aligned with the breech carrier interrupted threads 32 and the breech plug interrupted threads 34) to unlock the breech plug assembly 20.

In the disengaged disposition, the breech plug assembly 20 is free to translate relative to the chamber 10*a*. When the breech plug assembly 20 is unlocked, as noted above, the spur gear 73 of the of the translate mechanism 60 is engaged with a certain interrupted thread 34 of the breech plug assembly 20 and actuation of the spur gear 73 acts to selectively translate the breech plug assembly 20 axially aft to withdraw the breech plug assembly 20 from the variable volume chamber 10*a* and, with opposite actuation of the translate mechanism 60, to selectively translate the breech plug assembly 20 axially forward to insert the breech plug assembly 20 into the variable volume chamber 10*a*. See arrow 102 of FIG. 10*a*. Together, therefore, the translate mechanism 60 and the lock/unlock mechanism 65 are actuatable to effect both axial translation and locking/unlocking of the breech plug assembly 20 in the variable volume chamber 10*a*.

The breech carrier 23 includes a central bore 79 in alignment (when in the firing disposition) with the bore axis 19 of the cannon 12. The central bore 79 accomodates the insertion of a projectile 88, propellant 89 (see FIGS. 6*a–e*), and the breech plug assembly 20 into the variable volume chamber 10*a*.

Figure 4:
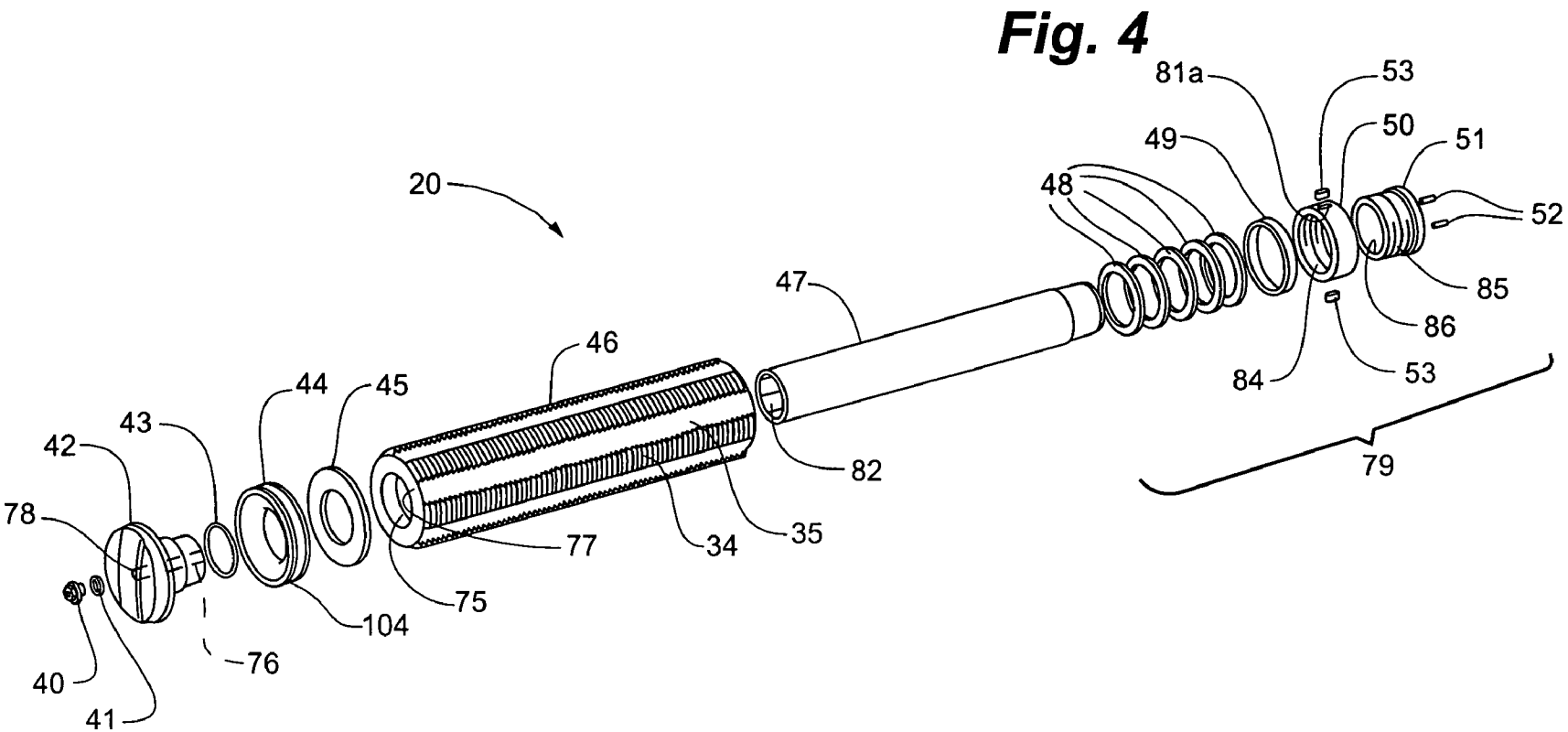
FIG. 4 is a exploded view of the breech plug assembly.
Figure 5:
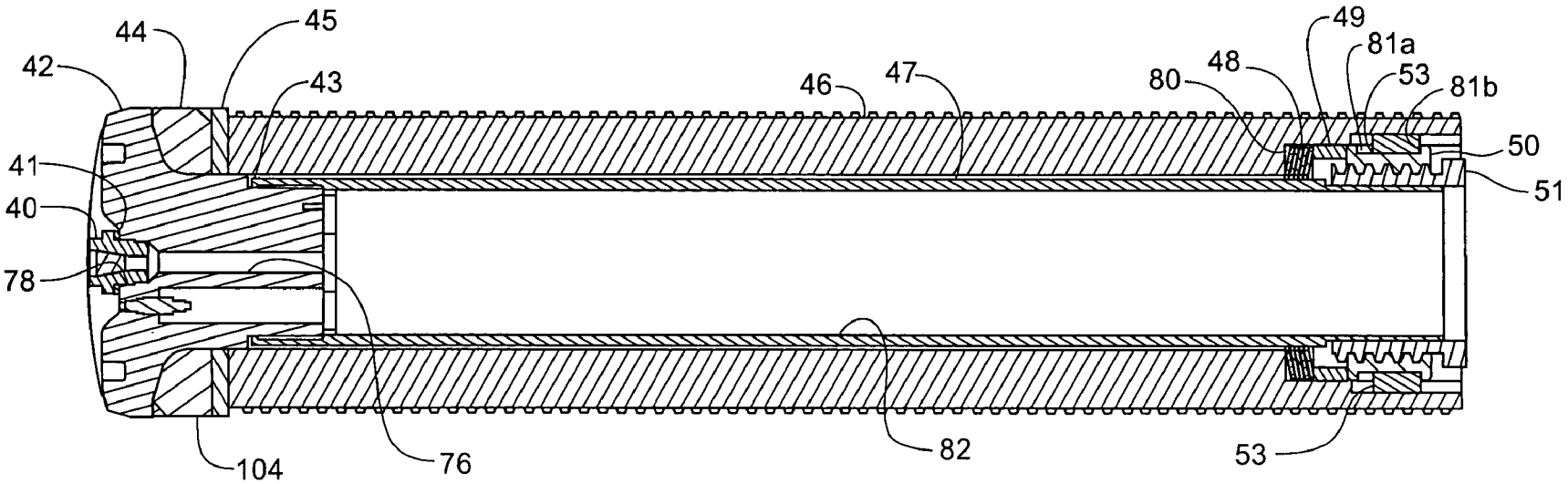
FIG. 5 is a cross sectional view of the breech plug assembly.
Figure 6A:
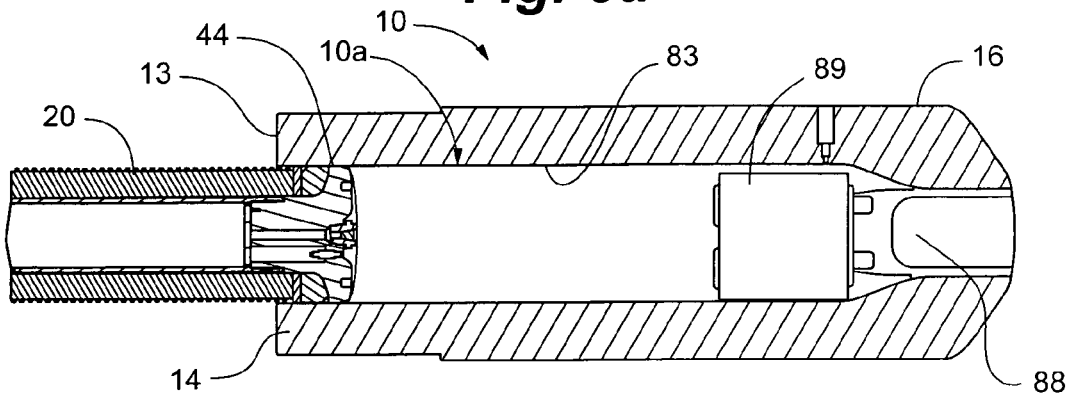
FIGS. 6*a–e* are a cross sectional views of the variable volume chamber geometry depicting the breech plug assembly in minimum and maximum chamber volume positions with various propellant quantities.
Figure 6B:
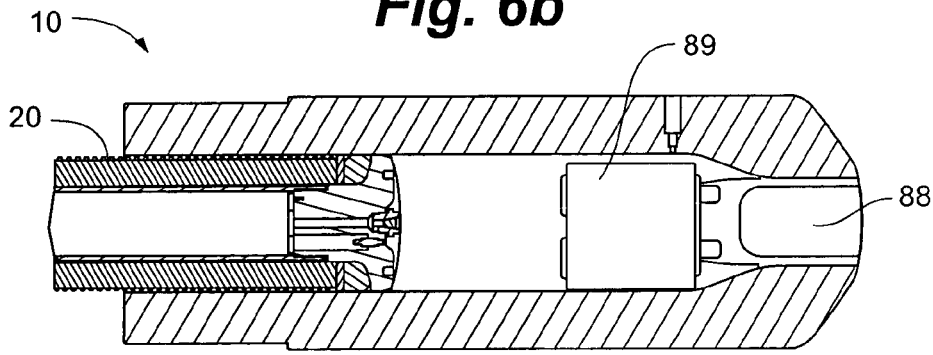
Figure 6C:
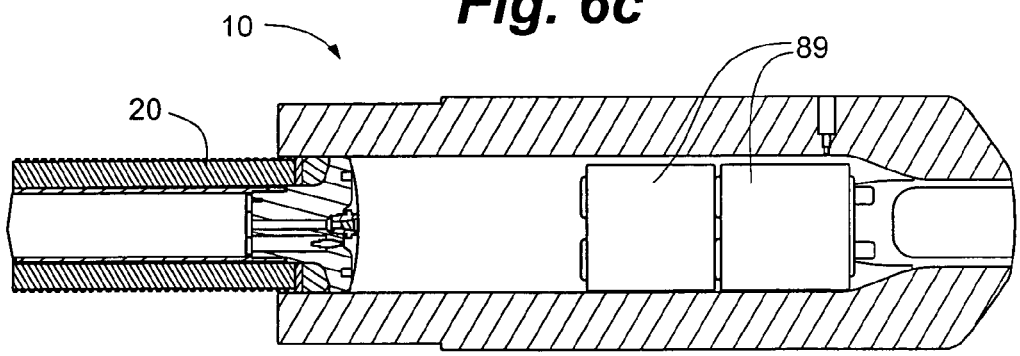
Figure 6D:
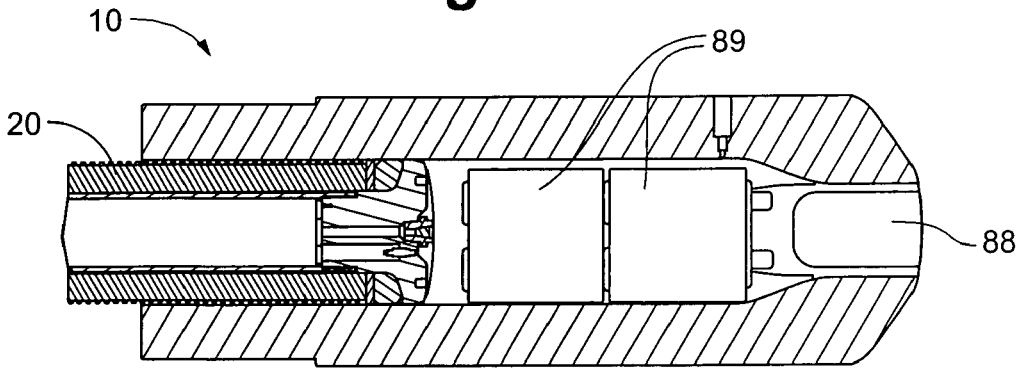
Figure 6E:
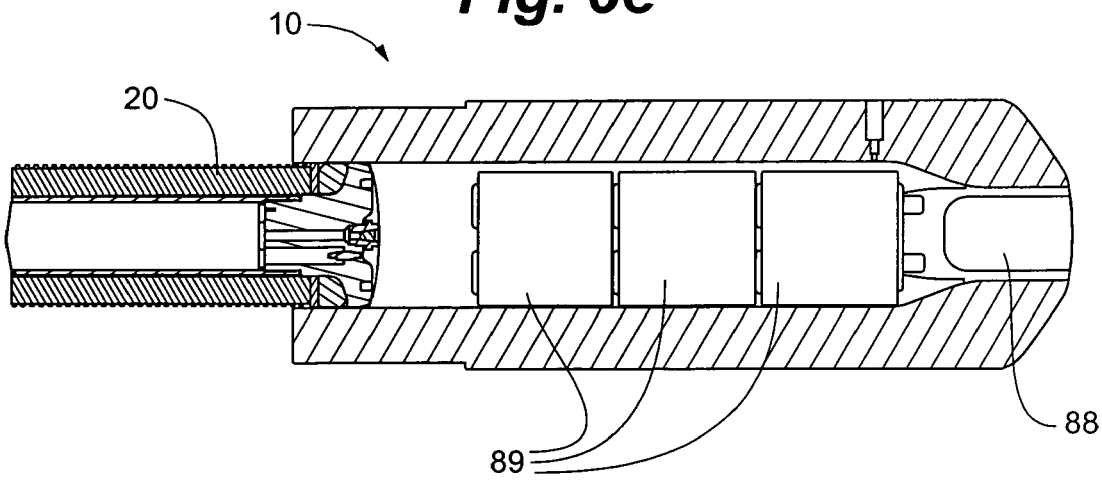

As depicted in FIGS. 4 and 5, the breech plug assembly 20 has a generally cylindrical thick walled metallic breech plug 46 having an axial bore 75. The outer margin of the breech plug 46 has the interrupted threads 34 having the alternating threads and interruptions 35 noted above. The axial bore 75 inner diameter is optically open, forming an optical pathway from the laser igniter assembly 25 mounted at the aft end of the breech carrier cover 24 (see FIG. 3), to the laser window 40 mounted in optical communication with an optical bore 76 defined in a spindle 42.

The forward end 77 of the breech plug 46 accommodates the spindle 42. The spindle 42 includes a forward opening 78 in which the laser window 40 is disposed for propagation of the laser energy coincident with the bore axis 19 from the laser igniter assembly 25 into the variable volume chamber 10*a* to ignite propellant disposed therein forward of the breech plug assembly 20. The spindle 42 is seated against a breech seal assembly 44. The breech seal assembly 44 is preferably formed of a material that deforms under compression and has a shape memory such that the material returns to the original shape upon the removal of the compressive force. More particularly, the breech seal 44 is preferably formed of an elastomeric material. The material must expand radially when compressed axially in order to seal and unseal with the chamber wall 83, as described in greater detail below.

The spindle 42 has an aft directed axial, tubular spindle extension 47 that extends into the axial bore 75 of the breech plug 46. The extension 47 extends from spindle 42 to the preload nut 50. A breech seal backing ring 45 is interposed between the breech seal assembly 44 and the forward end 77 of the breech plug 46.

Figure 7:
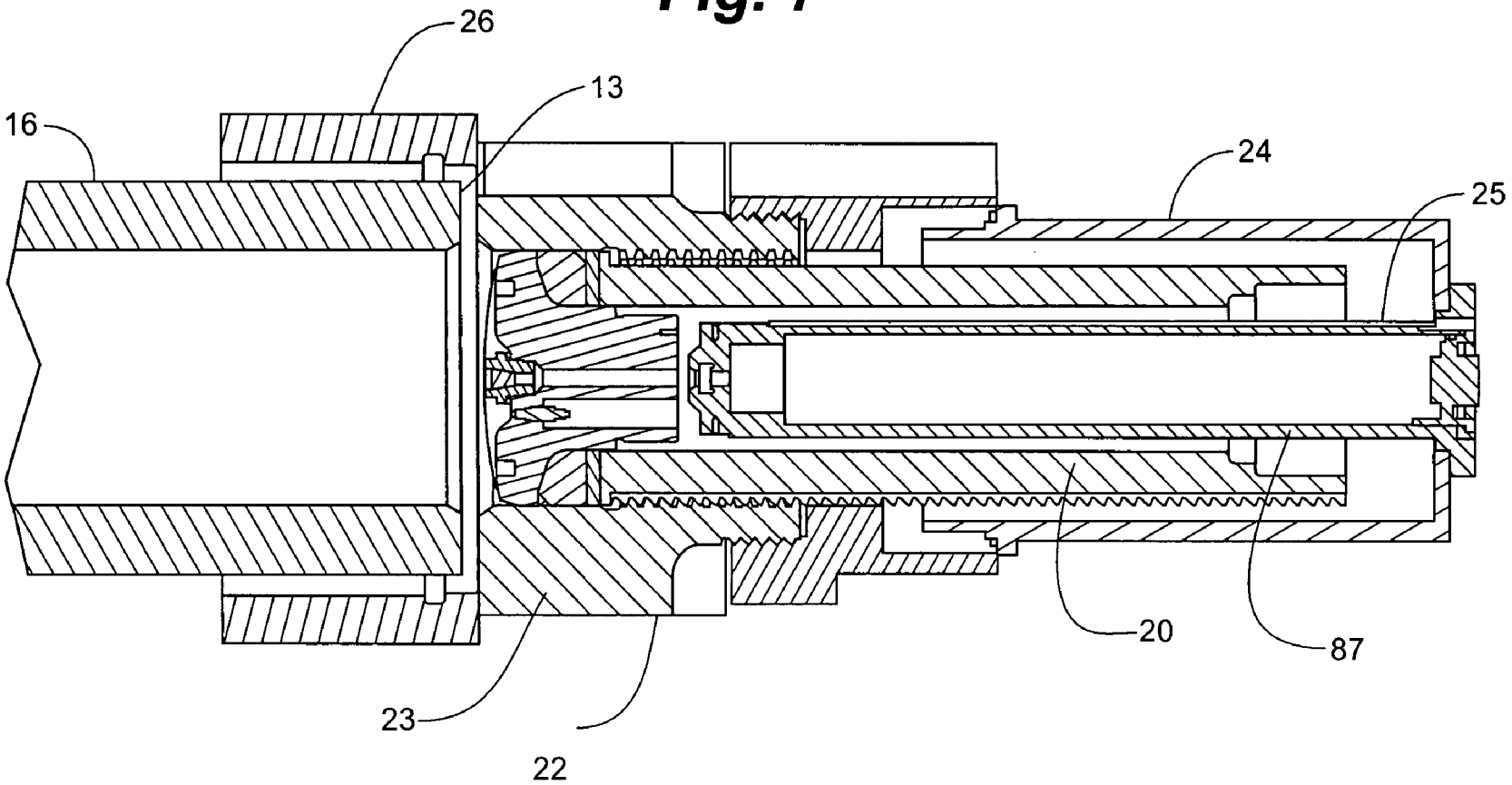
FIG. 7 is a cross sectional view depicting the breech plug assembly in the fully retracted position ready to extend the breech plug assembly leftward to adjust chamber volume or to lower the breech carrier assembly to load ammunition.

The laser igniter assembly 25 is illustrated in FIG. 2, 3, and 7. The laser igniter assembly 25 housing that operably inserts into the bore 82 of the spindle extension 47. The laser igniter assembly 25 housing is hexagonal in shape to correspond to the hex shape of the bore 82. The laser igniter assembly 25 is fastened to the cover assembly 24. The cover assembly 24 is then bolted to the breech carrier 23 of the breech carrier assembly 22. The laser igniter assembly 25 then translates with the breech carrier assembly 22.

FIGS. 6*a–e*depict the variable volume chamber assembly 10 of the present invention in various volume configurations of the chamber 10*a*. The breech seal assembly 44 is sized to be sealingly engaged against the constant inner diameter portion 83 of the variable volume chamber 10*a* when the breech plug assembly 20 is in the locked disposition. This is in contrast to the prior art fixed volume chamber designs in which the prior art seal has a chamfered face that is forced against a fixed chamfer at the rear face of the barrel. In distinction, the breech seal assembly 44 of the present invention, is capable of sealing at different axial depth positions depending on the volume of the variable volume chamber 10 needed for the propellant necessary for a firing solution. Such different positions are selectable and are indicated by the various views of FIGS. 6*a–e*.

FIGS. 6*a–e* illustrate the breech plug assembly 20 at a minimum (FIGS. 6*b, d*) and a maximum (FIGS. 6*a, c*, and *e*) volume position within the variable volume chamber 10. For maximum chamber volume of the chamber 10, the breech seal assembly 44 is disposed in sealing engagement very close to the rear face 13 of the breech end 14 of the barrel 16 and the breech plug assembly 20 is only partially inserted into the variable volume chamber 10 at a minimum depth, thereby leaving the bulk of the volume of the variable volume chamber 10 free to receive a large charge of propellant 89 for the imparting a desired velocity to the projectile 88. For minimum chamber volume, the breech plug assembly 20 is fully inserted into the breech assembly 18 and the variable volume chamber 10. The breech seal assembly 44 is disposed at a depth well into the variable volume chamber 10. It should be noted that various propellant units 89 are compatible with varying volumes defined in the chamber 10*a*. Igniting a relatively small propellant 89 in a relatively large volume of the chamber 10 (see FIG. 6*a*) has the effect of reducing the velocity imparted to the projectile 88.

Figure 10B:
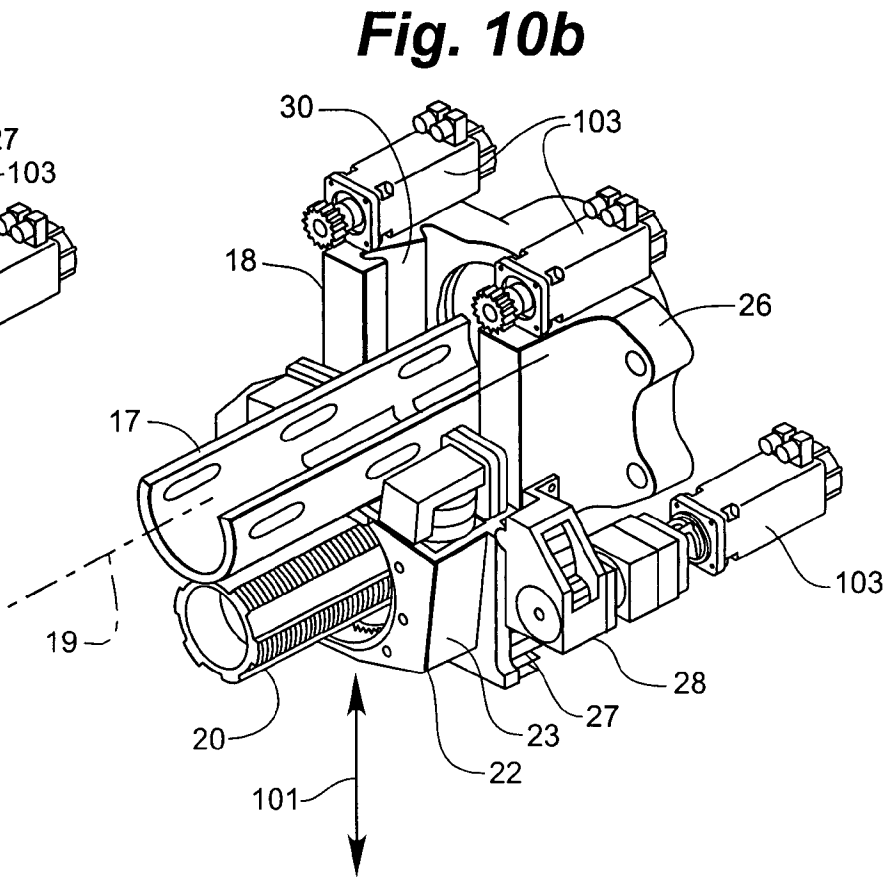
FIGS. 10*a–b* are perspective views depicting the breech operating sequence.
Figure 10A:
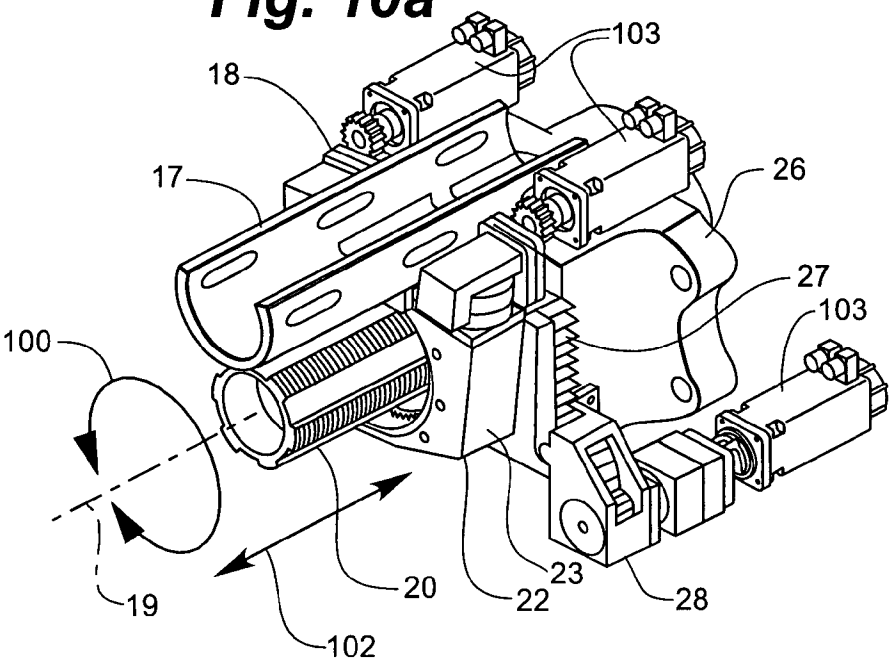
Figure 11:
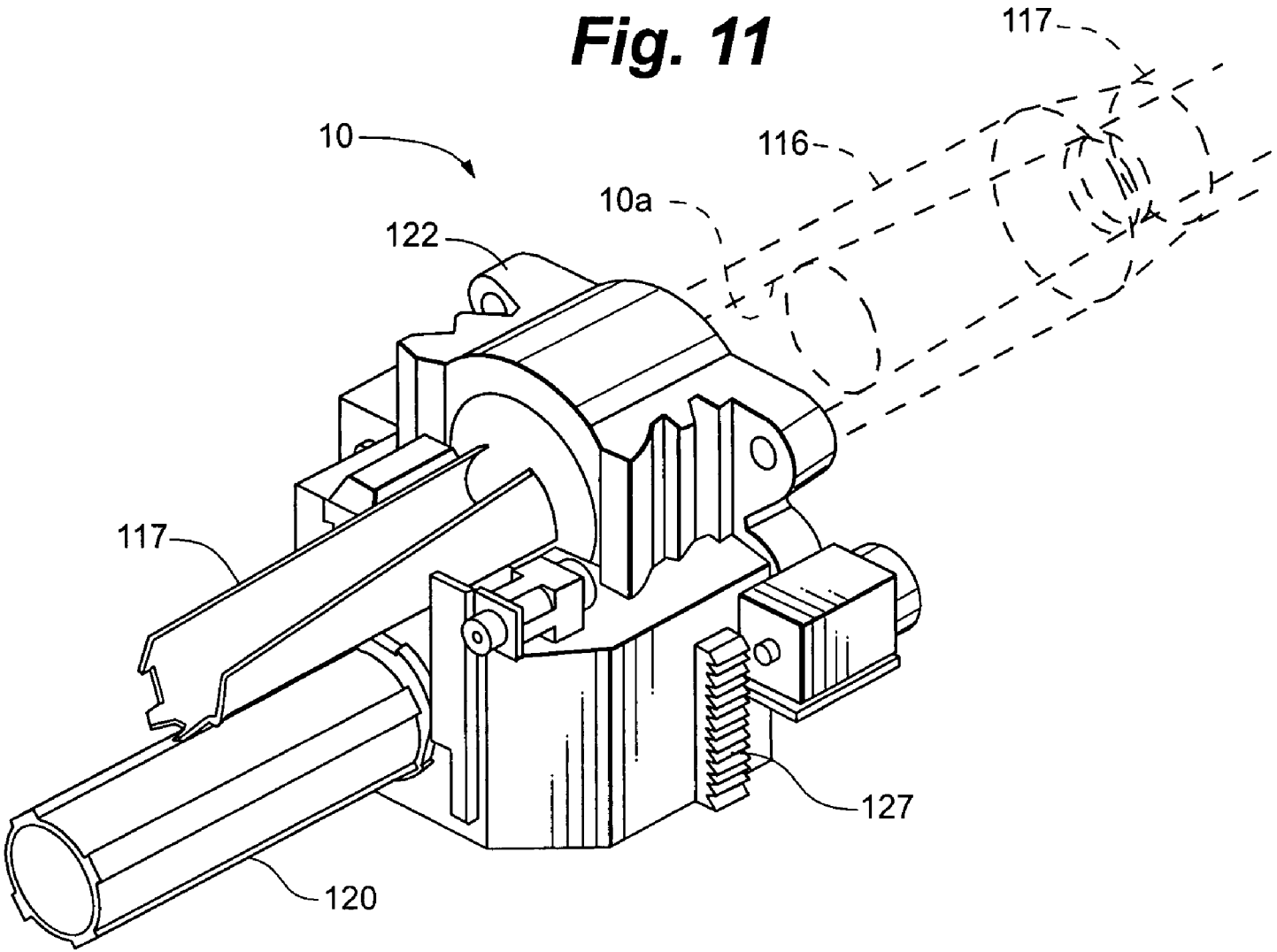
FIG. 11 is a perspective view of a second embodiment of the present invention.

FIGS. 10*a, b* illustrate the relative location of the breech assembly 18 and breech carrier assembly 22. The breech carrier assembly 22 provides the means to raise and lower the breech plug assembly 20 for loading of the cannon 12. In the lowered disposition depicted in FIG. 10*b*, the variable volume chamber 10*a* is cleared (the breech is open) and the cannon 12 is ready for loading. In the raised disposition with the breech plug assembly 20 translated into the variable volume chamber 10 and locked therein, the cannon 12 is in the battery disposition. If a round 88 and propellant 89 have been loaded into the variable volume chamber 10, cannon 12 is ready for firing. The breech carrier 23 is translatable orthogonally (radially) with respect to the bore axis 19 (see arrow 101 of FIG. 10*b*) in interiorly defined lugs 30 in the breech ring 26. The loading tray 17 is disposed on the breech carrier 23 and translates radially therewith for the loading of ammunition when the breech carrier 23 is in the lowered disposition of FIG. 10*b*.

The breech opening sequence is illustrated in FIGS. 10*a* and *b*. Starting with the breech plug assembly 20 locked within the breech as depicted in FIGS. 6*a–e*, in operation, the breech plug assembly 20 is rotated (see arrow 100) from a locked to an unlocked position within the barrel by the lock/unlock mechanism 65. The unlocking action aligns the breech carrier interruptions 33 with the breech plug threads 34 of the breech plug assembly 20 via the internal splines 69 of sector gear 68, as depicted in FIG. 8 and disengages the breech seal 44 from the chamber wall 83. The breech plug assembly 20 is then axially translated rearward (see arrow 102) until the breech plug assembly 20 is free of the breech ring 26 by the translate mechanism 60, as depicted in FIGS. 7 and 9. The breech carrier assembly 22 is then lowered (see arrow 101) by the breech carrier mechanism 28, in turn lowering the entire breech plug assembly 20 and load tube 17 to allow for loading of propellant and projectile. The lowering is effected by activation of the breech carrier gear box mechanism 28 by a respective motor 103, the breech carrier gear box mechanism 28 effecting orthogonal displacement on the breech carrier racks 27, thus dropping the breech plug assembly 20 clear of the bore and aligning the load tube 17 with the bore axis 19. The breech closing sequence is the reverse of the opening sequence.

FIGS. 7 and 10*a* illustrate the breech plug assembly 20 after rotational unlocking by actuation of the lock/unlock mechanism 65 and after a rearward translation by the translate mechanism 60 so as to position the breech plug assembly 20 clear of the breech assembly 18.

In FIG. 10*b*, the breech carrier assembly 22 and the breech plug assembly 20 have been lowered and the load tube 17 is aligned with the bore axis 19 in position for loading. Lowering (and raising) is effected by actuation of the breech carrier gear box mechanism 28 acting on the racks 27. The breech carrier lugs 31 slide on the breech ring lugs 30 during lowering and raising.

The present invention for varying the volume of the cannon chamber generally requires that the breech seal 44 be capable of sealing in more than one position in the chamber 10*a*, which precludes the use of a prior art sealing chamfer on the gun tube. Many modern artillery cannon use modular (uncased) propellant that is separated from the projectile. Without a case for the propellant, it is necessary for the cannon to ensure that exhaust gases do not escape from the breech during firing. This is typically presently accomplished by a seal that is forced against a chamfered surface machined in the chamber. Such sealing results in the same volume of the chamber for each shot. In distinction, the present invention includes the breech seal 44 that is configured to seal against the constant diameter chamber wall 83 at various depths rather than against a prior art chamfer at the rear face of the gun barrel, thereby resulting in variable chamber volumes.

The requirement of the breech seal 44 to perform at multiple positions along the fixed diameter portion 83 of the combustion chamber 10*a* in order to have a variable volume chamber cannon forces other system requirements. See FIGS. 5, 6*a–e*, and 7. The breech seal assembly 44 cannot be sealed prior to locking of the breech plug 20. In fact it must have an annular clearance between the circumferential margin 104 of the seal 44 and the chamber wall 83 in order to vent trapped air as the breech plug assembly 20 is driven into the combustion chamber, the barrel 16 being effectively sealed by the projectile 88. Once at the desired chamber volume of the chamber 10*a*, the seal 44 must close the annular gap and seal effectively on the chamber wall 83 against the extremely high temperature and pressures associated with artillery cannons. The seal 44 has to provide this functionality at gun tube temperature extremes from −60° F. to 350° F. along with being tolerant to the dirt and residue in the chamber 10*a* from firing the cannon. The seal preload mechanism 79 is the device that enables this functionality.

Once the breech plug assembly 20 is inserted into the combustion chamber 10*a* to the desired depth, the breech plug assembly 20 is rotated via the lock/unlock mechanism 65 to the locked disposition. A preload nut 50 is keyed by keys 53 to the rear of the of the breech plug 46. The preload nut 50 thereby rotates with the breech plug assembly 20. The internal thread 84 of the preload nut 50 engages the external thread 85 of the spindle lock 51. The spindle lock 51 has an internal hexagonal shaped bore 86 that the external hexagonal shaped housing 87 of laser igniter assembly 25 fits inside of regardless of the position of the breech plug 20 in the chamber 20. Since the laser igniter assembly 25 is fixed to the cover housing 24 and the cover housing 24 is fixed to the breech carrier 23, none of these components can rotate.

The breech ring lugs 30 interface with the breech carrier lugs 31 do not allow rotation, as depicted in FIG. 3. The spindle extension 47 is hollow, providing space for the laser igniter assembly 25 therein. The spindle extension 47 is also pinned to the spindle lock 51 and cannot rotate. The spindle extension 47 passes thru the bore 75 of the breech plug 46 and is fastened to the spindle assembly 42, thereby trapping the breech seal assembly 44 and breech seal backing ring 45 between the spindle 42 and the front surface 77 of the breech plug 46. The breech seal preload mechanism 79 works by the preload nut 50 turning with the breech plug assembly 20 as the breech plug assembly 20 is locked and reacting with the threads 85 on the spindle lock 51. Since the spindle lock 51 cannot rotate, the preload nut 50 rotates relative to the spindle lock 51 and therefore must translate axially as a function of the threaded rotation. The axially translation pulls the spindle 42 rearward (rightward in FIG. 4) towards the breech plug 46. This action first takes up any axial gap and secondly results in squeezing the elastomeric seal 44 which results in the diameter of the seal 44 increasing and forcing the expanded circumferential margin 104 of the seal 44 to close the radial annular gap at the chamber wall 83 and to assume a compressive sealing engagement with the chamber wall 83.

To provide the capability to operate in clean and dirty environments along with the noted temperature extremes, the preload nut 50 bears against a spacer 49 that acts on a belleville spring pack 48. The belleville spring pack 48 is designed to provide a near zero spring rate once a certain compressive force is achieved on the belleville spring pack 48. This gives a constant preload force or preload pressure in the breech seal 44 regardless of temperature, residue, or manufacturing tolerances.

After firing, the breech plug assembly 20 is rotated to disengage with the breech carrier 23 interrupted threads 32. This motion unloads the breech seal 44 as the spindle 42 is driven forward by the bias exerted by the belleville spring pack 48, thereby relieving the compressive force on the seal 44 and allowing the seal 44 diameter to contract again creating a radial annular gap between the circumferential margin 104 of the seal 44 and the chamber wall 83 that allows for easy extraction of the breech plug assembly 20 from the combustion chamber 10*a*.

Figure 12:
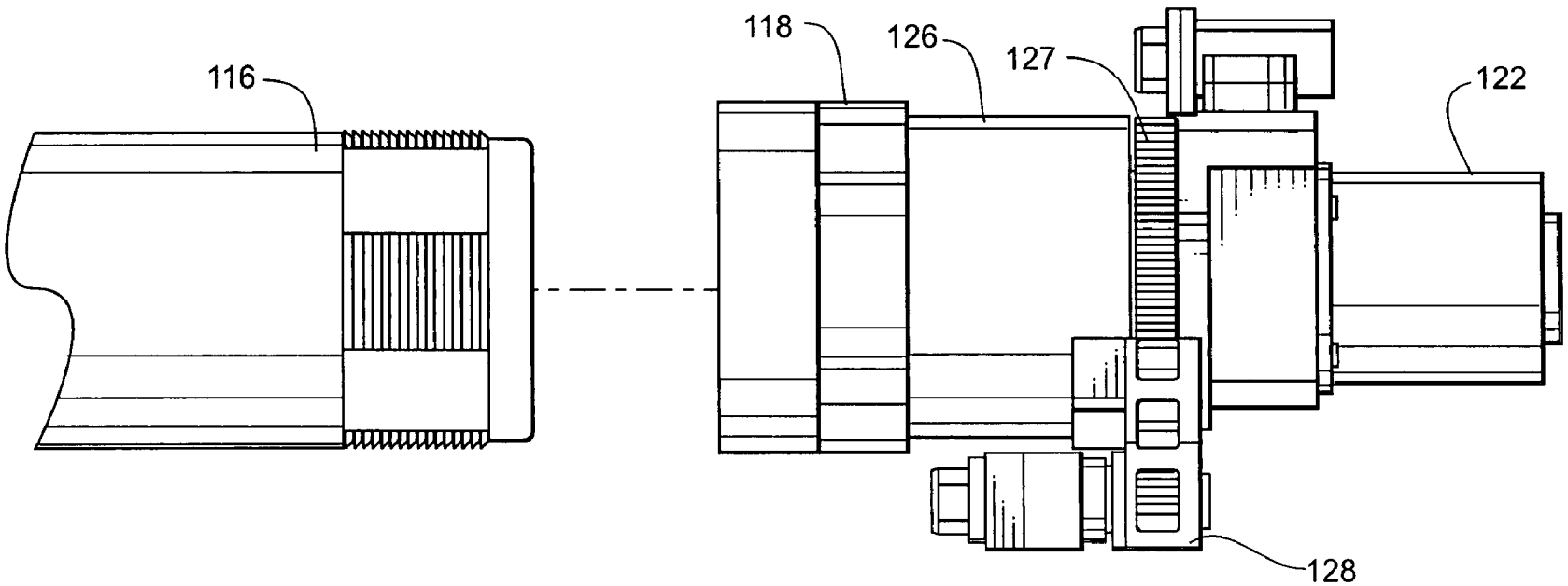
FIG. 12 is an elevational view of the barrel and breech assembly of the embodiment of claim 11.
Figure 13:
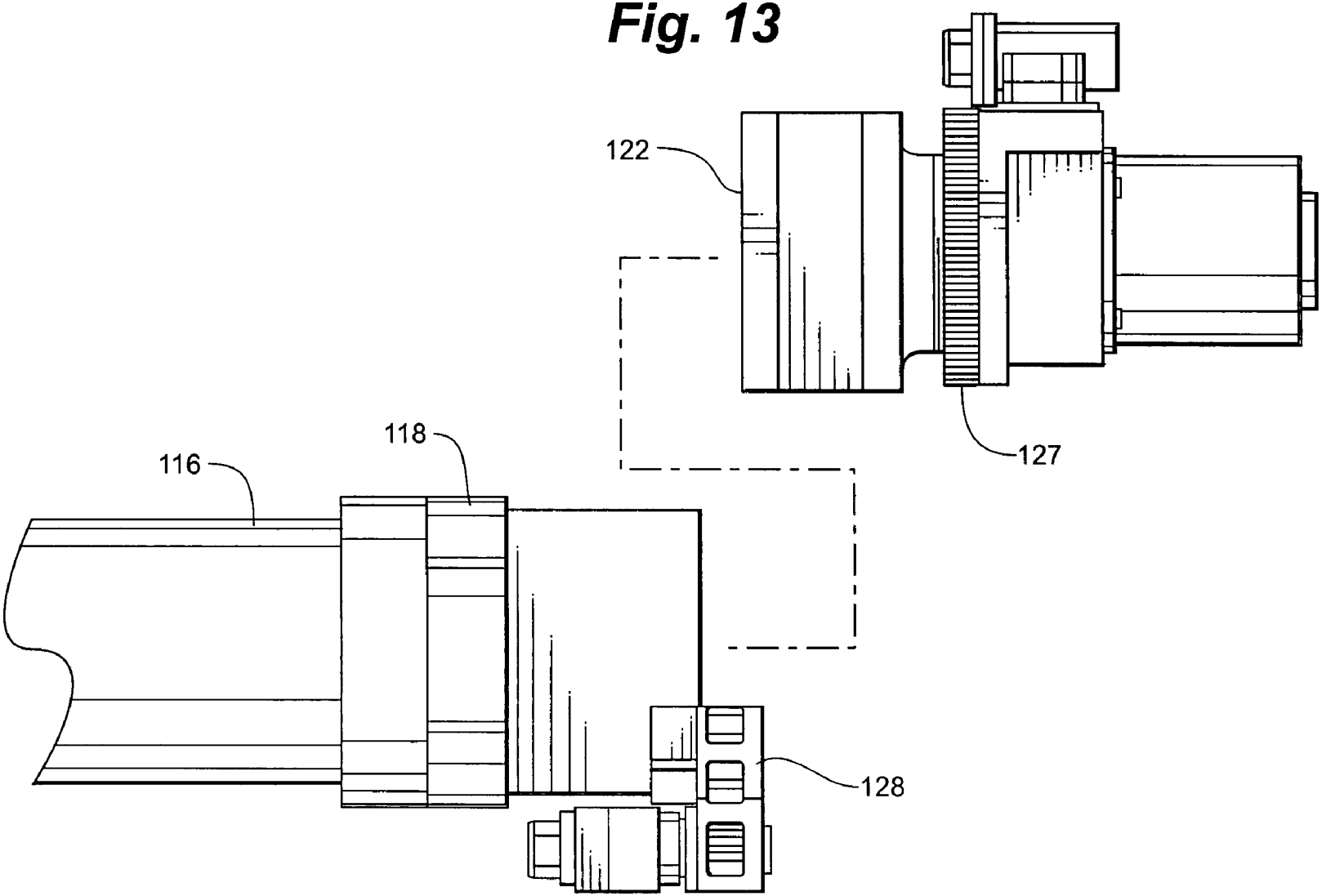
FIG. 13 is an elevational view of the breech assembly of the embodiment of claim 11.
Figure 14:
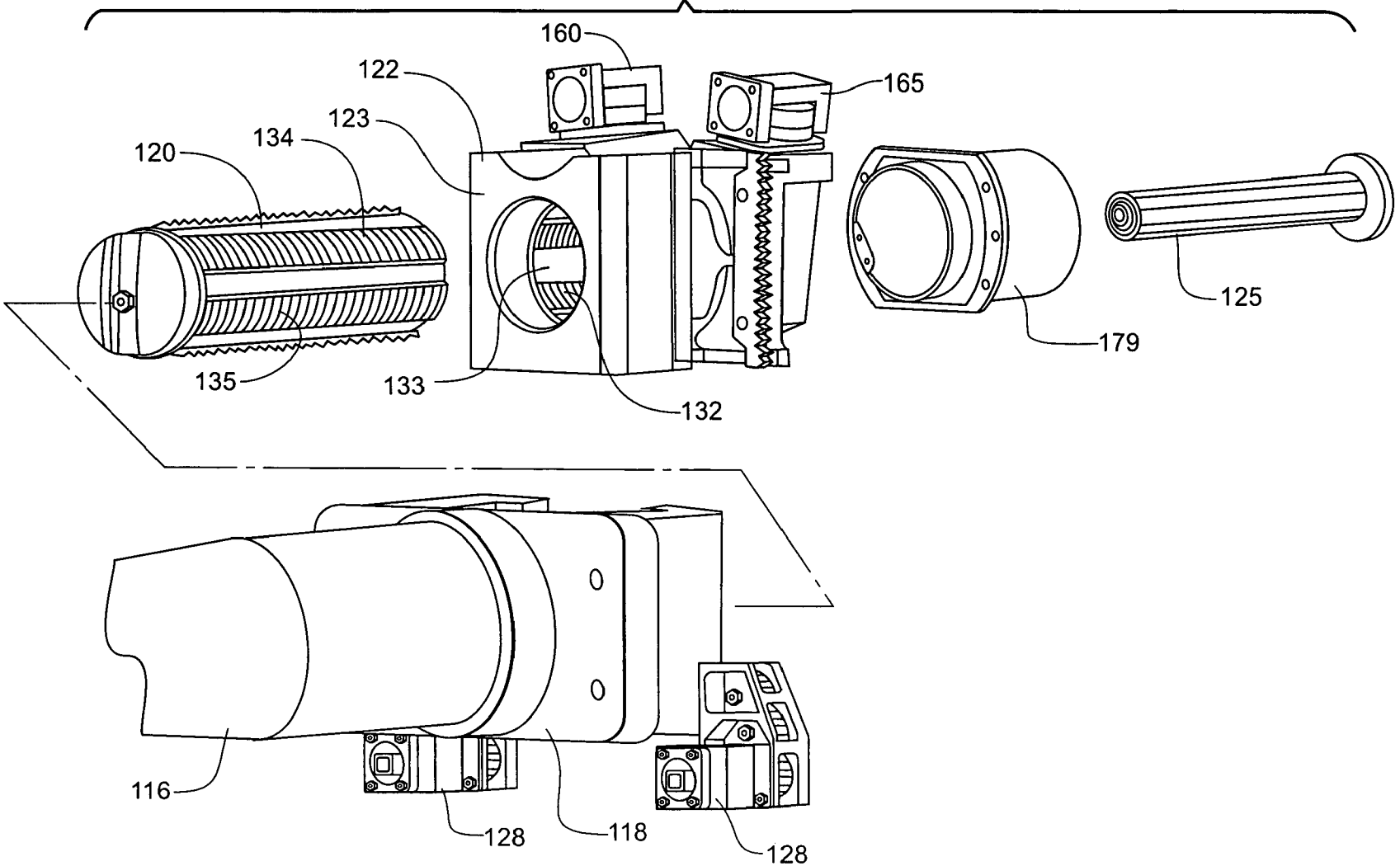
FIG. 14 is an elevational view of the breech carrier assembly of the embodiment of claim 11.

The components of a second embodiment of the Variable Volume Cannon Assembly 110 are illustrated in detail in FIGS. 11–15. Generally, this embodiment has an external breech block design as distinct from the internal breech block design of the embodiment noted above. For ready reference, components corresponding to components have a numeral designation that is 100 numbers greater. The variable volume chamber cannon assembly 110 has a cannon barrel 116 and breech assembly 118 as illustrated in FIG. 12. The cannon barrel 116 preferably comprises a rifled gun tube 117 with a variable control combustion chamber 110*a*. The breech assembly 118 consists of a breech ring 126 that receives a breech carrier assembly 122 as illustrated in FIG. 12. The breech carrier assembly 122, as illustrated in FIG. 13, consists of breech plug assembly 120, breech carrier assembly 122, preload mechanism 179, and laser igniter 125. The breech plug assembly 120 has external interrupted threads 134 as illustrated in FIG. 14, and operably inserts into the breech carrier assembly 122 at variable depth define variable volume chamber positions of the chamber 110*a*. The preload mechanism 179 attaches to the breech carrier assembly 122 on the rearward side of the breech carrier assembly 122 in the manner noted above. The laser igniter assembly 125 operably inserts into the interior axial bore 75 of the breech plug assembly 20 in the manner noted above.

Figure 15:
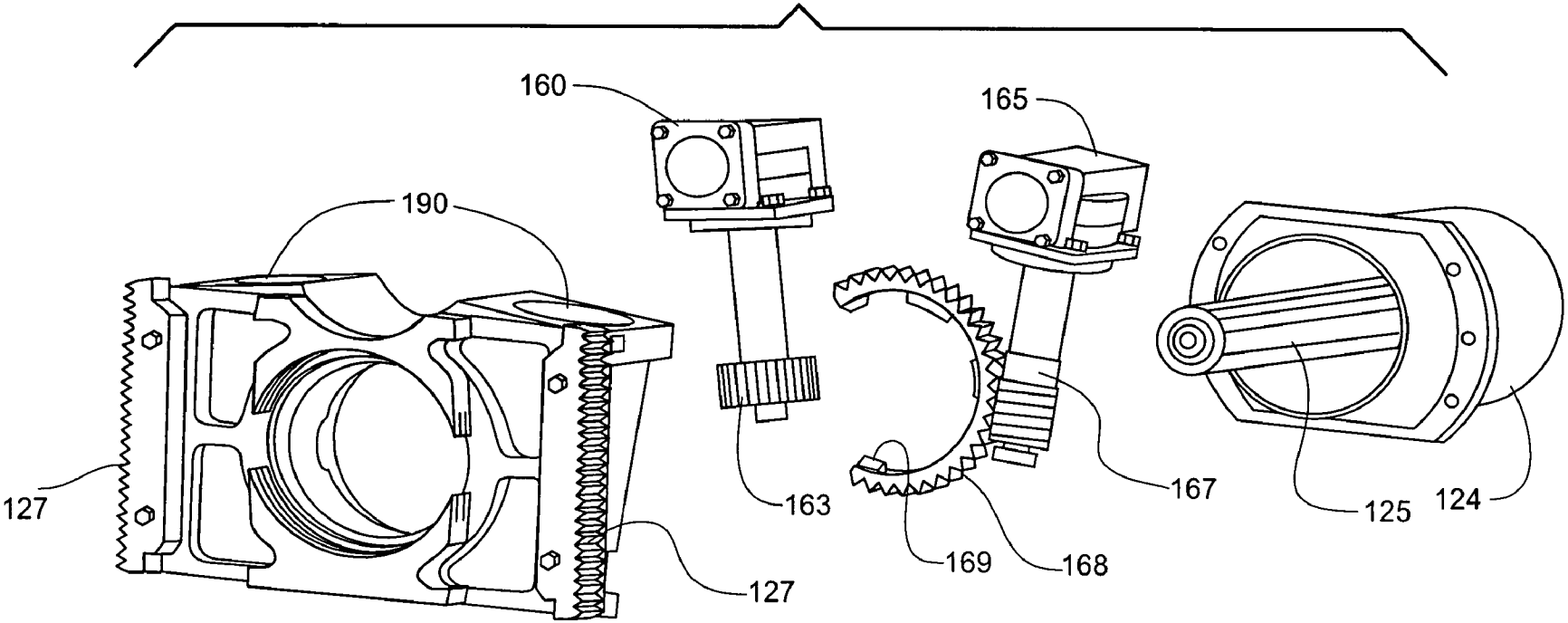
FIG. 15 is an exploded view of the barrel and breech assembly of the embodiment of claim 11.

As illustrated in FIG. 15, the breech carrier assembly 122 comprises a locking gear housing, which receives a rotatable locking gear 168. The locking gear 168 includes splines 169. consiistent with the description above, the breech plug assembly 120 is lockable in the breech carrier 122 by the engagement of the interrupted threads 132 and 134. Translation of he breech plug assembly 120 is effected by the breech plug translate mechanism after alignment of the interrupted thread 132 with the interruption 135.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A cannon having a barrel, the barrel having at least one certain bore diameter defined about a bore axis and defining a certain bore size and having a muzzle end and an opposed breech end, and a single chamber disposed at the breech end, a breech assembly operably coupled to the chamber, the cannon comprising;

the chamber having a fixed diameter region of a chamber wall, a breech plug assembly selectively axially translatable in the fixed diameter region of a chamber wall and rotatable to effect locking at a desired disposition in the chamber, and a breech seal that is axially translatable responsive to the rotational locking of the breech plug assembly to effect a breech seal diameter increase that compressively, sealing engages a seal margin with the chamber wall.

2. The cannon of claim 1, the variable volume chamber being sized to accommodate at least one propellant charge, the propellant charge being specifically designed for cannon of a differing bore size.

3. The cannon of claim 1, the variable volume chamber being sized to accommodate the propellant charge of a plurality of different bore size cannon, thereby supporting a single modular uni-charge propellant system having a propellant charge that may be commonly used for the plurality of different bore size cannon.

4. The cannon of claim 1, the variable volume chamber accommodating selecting both varying chamber volumes and varying propellant quantities as a means for varying the projectile muzzle exit velocity for each round fired from the cannon.

5. The cannon of claim 1, wherein the variable volume chamber has a fixed, constant diameter extending a substantial portion of the known depth dimension of the chamber.

6. The cannon of claim 5, the breech plug assembly being sealable with the chamber inner wall margin at selected depths within the fixed, constant diameter of the chamber inner wall margin.

7. The cannon of claim 5, including the breech assembly having a breech carrier, a breech ring and the breech plug assembly, the breech plug assembly being receivable into the chamber to a desired depth before rotationally locking the breech plug assembly therein by means of engaging interrupted teeth of the breech plug assembly with interrupted teeth of the breech carrier.

8. The cannon of claim 7, wherein whereby the breech plug assembly is receivable into the chamber to a desired depth by aligning the interrupted teeth of the breech plug assembly with the interruptions of the teeth of the breech carrier.

9. The cannon of claim 7, the breech carrier being selectively orthogonally shiftable relative to the chamber, shifting of the breech carrier acting to carry the breech plug assembly therewith for disposing the breech plug assembly in a loading disposition shifted from a chamber longitudinal axis.

10. The cannon of claim 9, the breech carrier having lugs disposed between the breech carrier and a fixed breech ring, the lugs acting as guides to shift the breech carrier and the fully retracted breech plug assembly orthogonally relative to the bore axis to permit the loading of ammunition axially into the chamber.

11. The cannon of claim 1, breech plug assembly including a spindle disposed at a forward end of the breech plug assembly and a breech seal disposed circumferential to the spindle, the breech seal being sealable with the chamber at a plurality of selectable depths within the chamber.

12. The cannon of claim 1, the breech plug assembly having an axial bore defined therein, the axial bore accommodating an the ignition source, the ignition source for igniting propellant charges.

13. The cannon of claim 12, the ignition source for igniting propelling charges being a laser.

14. The cannon of claim 1 wherein a cannon breech is opened by rotating the breech plug assembly within a breech carrier to unlock interrupted threads disposed on both the breech plug assembly and the breech carrier, axially translating the breech plug assembly aft until the breech plug assembly is clear of the chamber and radially shifting the breech carrier and breech plug assembly relative to the bore axis to clear the path to the chamber for ammunition loading.

15. An assembly for effecting a variable volume chamber for use in a cannon having a barrel, the barrel having at least one certain bore diameter defined about a bore axis and having a muzzle end and an opposed breech end, a single chamber disposed at the breech end, and a breech assembly operably coupled to the chamber, the assembly comprising;

the chamber having a fixed diameter region of a chamber wall, a breech plug assembly selectively axially translatable in the fixed diameter region of a chamber wall and rotatable to effect locking at a desired disposition in the chamber, and a breech seal that is axially translatable responsive to the rotational locking of the breech plug assembly to effect a breech seal diameter increase that compressively, sealing engages a seal margin with the chamber wall.

16. The assembly of claim 15, the variable volume chamber being sized to accommodate at least one propellant charge, the propellant charge being specifically designed for cannon of a differing bore size.

17. The assembly of claim 15, the variable volume chamber being sized to accommodate a propellant charge of a plurality of different bore size cannon, thereby supporting a single modular uni-charge propellant system having a propellant charge that may be commonly used for the plurality of different bore size cannon.

18. The assembly of claim 15, the variable volume chamber accommodating selecting both varying chamber volumes and varying propellant quantities as a means for varying the projectile muzzle exit velocity for each round fired from the cannon.

19. The assembly of claim 15, wherein the variable volume chamber has a fixed, constant diameter substantially the known depth dimension of the chamber.

20. The assembly of claim 19, the breech plug assembly being sealable with the chamber inner wall margin at any depth within the fixed, constant diameter of the chamber inner wall margin.

21. The assembly of claim 19, including the breech assembly having a breech carrier, a breech ring and the breech plug assembly with associated electric drive motors and drive mechanisms and including an interrupted thread design between the breech plug assembly and the breech carrier whereby the breech plug assembly is receivable into the chamber to a desired depth before rotationally locking the breech plug assembly therein by means of engaging the interrupted teeth of the breech plug assembly with the interrupted teeth of the breech carrier.

22. The assembly of claim 21, wherein the breech plug assembly is receivable into the chamber to a desired depth by aligning the teeth of the breech plug assembly with the interruptions of the teeth of the breech carrier.

23. The assembly of claim 21, the breech carrier being selectively shiftable relative to the chamber, shifting of the breech carrier carrying the breech plug assembly therewith for disposing the breech plug assembly in a loading disposition shifted from a chamber longitudinal axis.

24. The assembly of claim 23, the breech carrier having lugs disposed between the breech carrier and a fixed breech ring, the lugs acting as guides to shift the breech carrier and the fully retracted breech plug assembly to permit the loading of ammunition axially into the chamber.

25. The assembly of claim 15, the breech plug assembly including a spindle disposed at a forward end of the breech plug assembly and a breech seal disposed circumferential to the spindle, the breech seal being sealable with the chamber at substantially all depths within the chamber.

26. The assembly of claim 15, the breech plug assembly having an axial bore defined therein, the axial bore accommodating an the ignition source, the ignition source for igniting propelling charges.

27. The assembly of claim 26, the ignition source for igniting propelling charges being a laser.

28. The assembly of claim 15 wherein a cannon breech is opened by rotating the breech plug assembly within a breech carrier to unlock interrupted threads disposed on both the breech plug assembly and the breech carrier, axially translating the breech plug assembly aft until a spindle is removed from the chamber and radially shifting the breech carrier and breech plug assembly to clear the path for ammunition loading.

29. A method for effecting a variable volume chamber for use in an automated cannon having a barrel, the barrel having at least one certain bore diameter and having a muzzle end and an opposed breech end, a single chamber disposed at the breech end, and a breech assembly operably coupled to the chamber, the method comprising;

defining a fixed diameter region of a chamber wall;

defining a known volume of the chamber, the known volume for receiving therein a projectile and a volume of propellant by means of by a circumferential inner wall margin and having a known depth dimension and;

defining a chamber variable volume by disposing a breech plug assembly in the chamber to a selectively variable depth, the depth being less than a known depth of the chamber such that the breech plug assembly fills a first selectively variable portion of the known volume of the chamber, thereby leaving a second variable portion of the known volume of the chamber free and defining a chamber variable volume.

30. The method of claim 29, including sizing the variable volume chamber to accommodate at least one propellant charge, the propellant charge being specifically designed for cannon of a differing bore size.

31. The method of claim 29, including sizing the variable volume chamber to accommodate a propellant charge of a plurality of different bore size cannon, thereby supporting a single modular uni-charge propellant system having a propellant charge that may be commonly used for the plurality of different bore size cannon.

32. The method of claim 29, the variable volume chamber accommodating selecting both varying chamber volumes and varying propellant quantities as a means for varying the projectile muzzle exit velocity for each round fired from the cannon.

33. The method of claim 29, including defining the variable volume chamber by means of a fixed, constant diameter substantially the known depth dimension of the chamber.

34. The method of claim 29, including sealing with the chamber at any depth within the fixed, constant diameter of the by means of a breech plug assembly.

35. The method of claim 29, including:

providing a plurality of interrupted teeth on the breech plug assembly and cooperatively matable interrupted teeth on a breech carrier;

aligning the teeth of interrupted teeth of the breech plug assembly with the interruptions between interrupted teeth of a breech carrier;

axially translating the breech plug assembly into the variable volume chamber to a desired depth; and rotationally locking the breech plug assembly in the variable volume chamber by engaging the interrupted teeth of the breech plug assembly with the interrupted teeth of the breech carrier.

36. The method of claim 29, including shifting the breech plug assembly orthogonally relative to a chamber longitudinal axis for disposing the breech plug assembly in a loading disposition shifted from the chamber longitudinal axis.

37. The method of claim 29, including forming the breech plug assembly cooperatively with the chamber such that the breech plug assembly is sealable with the chamber inner wall margin at substantially all depths within the chamber.

38. The method of claim 29, including defining an axial bore in the breech plug assembly and disposing an ignition source for igniting propellant charges in the axial bore.

39. The method of claim 38, including providing a laser as the ignition source for igniting propelling charges.

40. The method of claim 29 including rotating the breech plug assembly within a breech carrier to unlock interrupted threads disposed on both the breech plug assembly and the breech carrier, axially translating the breech plug assembly aft until the breech plug assembly is removed from the chamber and radially shifting the breech carrier and breech plug assembly relative to a chamber longitudinal axis to clear the path for ammunition loading.

41. A variable volume chamber assembly for a cannon, comprising:

a chamber having a fixed diameter region of a chamber wall, a breech plug assembly selectively axially translatable in the fixed diameter region of a chamber wall and rotatable to effect locking at a desired disposition in the chamber, and a breech seal that is axially translatable responsive to the rotational locking of the breech plug assembly to effect a breech seal diameter increase that compressively, sealing engages a seal margin with the chamber wall.

42. The variable volume chamber assembly of claim 41 having an internal breech block assembly.

43. The variable volume chamber assembly of claim 41 having an external breech block assembly.

* * * * *

UNITED STATES PATENT AND TRADEMARK OFFICE

CERTIFICATE OF CORRECTION

PATENT NO. : 7,243,589 B2
APPLICATION NO. : 11/060233
DATED : July 17, 2007
INVENTOR(S) : Jeff Ireland et al.

It is certified that error appears in the above-identified patent and that said Letters Patent is hereby corrected as shown below:

Column 2, Line 31:
After "comprises" delete "of".

Column 3, Line 20:
After "firing," insert --a--.

Column 3, Line 67:
Delete "Cannon" and insert --A cannon--.

Column 4, Line 14:
After "are" delete "a".

Column 5, Line 43:
After "60" delete "65".

Column 6, Line 27:
Delete the second occurrence of "of the".

Column 7, Line 21:
After "6a-e" insert a space.

Column 7, Line 46:
After "for" delete "the".

Column 9, Line 17:
Delete the second occurrence of "of the".

Column 10, Line 31:
Delete "consirstent" and insert --consistent--.

Column 10, Line 34:
Delete "he" and insert --the--.

Column 10, Line 58:
Delete "sealing" and insert --sealingly--.

Column 11, Line 47:
After "an" delete "the".

UNITED STATES PATENT AND TRADEMARK OFFICE

CERTIFICATE OF CORRECTION

PATENT NO. : 7,243,589 B2
APPLICATION NO. : 11/060233
DATED : July 17, 2007
INVENTOR(S) : Jeff Ireland et al.

It is certified that error appears in the above-identified patent and that said Letters Patent is hereby corrected as shown below:

Column 12, Line 7:
Delete "sealing" and insert --sealingly--.

Column 12, Line 62:
After "an" delete "the".

Column 13, Line 16:
After "of" delete "by".

Column 13, Line 17:
Delete "dimension and;" and insert --dimension; and--.

Column 13, Line 18:
Indent the paragraph.

Column 13, Lines 45-46:
Delete "of the".

Column 14, Line 42:
Delete "sealing" and insert --sealingly--.

Signed and Sealed this

Twenty-seventh Day of May, 2008

JON W. DUDAS
*Director of the United States Patent and Trademark Office*